United States Patent [19]

Mehl

[11] Patent Number: 4,536,462

[45] Date of Patent: Aug. 20, 1985

[54] ENCAPSULATED PARTICULATE MAGNETIC DEVELOPMENT POWDERS CONTAINING A SUBLIMABLE DYESTUFF

[75] Inventor: Wolfgang Mehl, Geneva, Switzerland

[73] Assignee: International Toner Specialties, Ogden, Utah

[21] Appl. No.: 554,273

[22] Filed: Nov. 22, 1983

[51] Int. Cl.[3] ..... G03G 9/08

[52] U.S. Cl. ..... 430/106; 430/106.6; 430/109; 430/110; 430/111; 430/138; 430/903; 428/402.24

[58] Field of Search ..... 430/137, 138, 109, 111, 430/106.6, 903, 106, 110; 428/407.2, 402.24

[56] References Cited

U.S. PATENT DOCUMENTS

| | | | |
|---|---|---|---|
| Re. 27,912 | 2/1974 | Miller | 430/106.6 |
| 4,145,300 | 3/1979 | Hendriks | 430/110 X |
| 4,230,784 | 10/1980 | Nishiguchi et al. | 430/120 X |
| 4,251,616 | 2/1981 | Hendriks | 430/106 X |
| 4,443,527 | 4/1984 | Heikens et al. | 430/106.6 X |
| 4,476,211 | 10/1984 | Hosoi | 430/138 X |

*Primary Examiner*—Roland E. Martin

*Attorney, Agent, or Firm*—Thorpe, North & Western

[57] ABSTRACT

A novel magnetic, electrophotographic, development or toner powder is provided comprising essentially spherical particles with a diameter between 5 and 50$\mu$. The particles contain small ferromagnetic particles, highly conducting carbon, at least 5% sublimable dyestuff and at least 4% of a surface active agent. The particles are preferably structured to have an inside nucleus zone containing dyestuff and surfactant and an outside shell zone which contains the magnetic material and the highly conducting carbon.

10 Claims, No Drawings

ENCAPSULATED PARTICULATE MAGNETIC DEVELOPMENT POWDERS CONTAINING A SUBLIMABLE DYESTUFF

BACKGROUND OF THE INVENTION

1. Field

This invention relates to and has as its principal objective improved particles of electrostatic development powders, often referred to as "toners", which are preferably spheres with a diameter of 5 to 50 microns and which consist of a binder in form of a high molecular weight organic substance which contains finely divided particles of ferromagnetic material.

2. State of the Art

Electrostatic development powders are used for the development of latent electrostatic images which have been generated through image-wise discharge by electromagnetic radiation of electrostatically charged organic or inorganic photoconductors.

The use of development powders which contain dispersed ferromagnetic material, usually magnetic iron oxide $Fe_3O_4$ (magnetite) is disclosed in U.S. Pat. No. 2,874,063, wherein it is taught that images are preferably developed by application of those powders utilizing a development station which comprises a cylinder of nonmagnetizable, magnetically transparent material (e.g. aluminum) which encloses magnetic rolls. The cylinder carries a layer of toner particles which are kept in place by magnetic forces. Such a development station is often referred to as "magnetic brush."

For the development of the latent electrostatic images, the photoconductor layer is transported past the development station and an electrostatic force is exerted upon the toner particles. The electrostatic force acts in the opposite direction to the magnetic attraction force associated with the cylinder which carries the toner particles. The toner particles are selectively transferred from the cylinder to the photoconductor surface at these locations where the electrostatic force is larger than the magnetic force. The toner can then be fixed upon the photoconductor surface by application of pressure or a combination of heat and pressure. Alternatively, the toner can be transferred by the xerographic process from the photoconductor to a sheet of normal paper and then fixed on the paper by application of pressure or a combination of pressure and heat.

U.S. Pat. Nos. 4,246,331, 4,145,300 and 4,134,676 teach that finely dispersed particles of dyestuff which are volatile at atmospheric pressure and temperatures between 100° C. and 220° C. can be incorporated in the toner particles. By development of latent electrostatic images with development powders containing such a dyestuff, single color transfer papers can be produced. The single color transfer papers can be used for heat transfer printing of various items and, in particular, of polyester fabrics. As described in French Pat. Nos. 1,233,330 and 1,585,119, the transfer paper is brought into contact with a polyester fabric, and through the application of heat and pressure, the dyestuff evaporates and is transferred from the transfer paper to the fabric on which a single color reproduction of the original is formed. This process leads to acceptable results for flat and lightweight woven fabrics. It would, however, be highly desirable to increase the pentration of the print into the fabric to avoid the "grinning" phenomenon, i.e.

the sight of the white, uncolored depth of the fabric when it is stretched.

Penetration of the dyestuff is generally insufficient when pile structures like carpets are heat transfer printed with the color transfer paper because only the very top of the pile structure is colored by the transfer process. For applications requiring deeper penetration, special "deep penetrating" dyestuffs have been proposed. Typical dyes which are representative of the deep penetrative types are the red dyestuffs 1-amino-2-chlor-4-hydroxyanthraquinone, 1-amino-2-brom-4-hydroxyanthraquinone, the blue dyestuff 1,4-diisopropylanthraquinone, and the yellow dyestuff having the formula

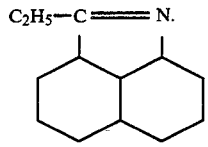

These special dyestuffs show good penetration and acceptable fastness values for heat transfer printing of polyamide 66, the standard fiber material for carpets, but the lightfastness values of the dyestuffs when used on polyester materials are poor.

The molecules of the highly volatile dyestuffs used in making the color transfer papers are quite mobile even at room temperature and for the toners described in U.S. Pat. Nos. 4,246,331, 4,145,300 and 4,134,676, the dyestuffs migrate on storage at room temperature to the surface of the toner particles. This is a distinct disadvantage inasmuch as the dyestuff at the surface of the toner particles tends to pollute the magnetic brush, which, in turn, results in an unselective, undesirable deposit of dyestuff on the surface of the photoconductor. This results in a commercially unacceptable transfer in which the printed article generally has an unacceptable, nonuniform colored background.

Problems have also been encountered with transfer papers utilizing conventional toners when the transfer papers are used in heat transfer printing of anodized aluminum. U.S. Pat. No. 3,484,342 teaches that anodically oxidized aluminum can be heat transfer printed as long as the pores of the oxide film are unsealed. Transfer papers carrying one or several sublimable dyestuffs are brought into contact with the oxide covered aluminum surface, and the sandwich is treated for 30 to 60 seconds at a temperature of from 180° C. to 210° C. The volatilized dyestuff is transferred by diffusion or absorption into the oxide film on the anodized aluminum. The dyestuff can be fixed in the pores of the oxide film by several known methods including sealing with boiling water. This heat transfer printing process can also be performed with papers produced by the electro-photographic process with conventional toners. However for this application by far the most important shade is black, and black images are only poorly reproduced, with shades of gray being obtained because of the limited dyestuff concentration in the toner particles.

Particularly good results with the electro-photographic process are achieved with a combination of the dyestuffs C.I. Disperse Yellow 54 (yellow), C.I. Vat Red 41 (magneta), C.I. Disperse Red 60 (bordeaux), C.I. Disperse Blue 331 (cyan), C.I. Disperse Violet 23 (blue), and C.I. Disperse Violet 27 (blue).

Another example for the technological and commercial importance of high intensity heat transfer prints is furnished by the printing of natural silk fabrics. The Japanese Patent Publication No. 53-78,366 teaches that silk fabrics can be heat transfer printed if the fibers are swollen with water and if the swollen state is maintained after drying by use of high molecular polydiols such as polyethylene glycol 300. The swollen state of the silk fibers can also be stabilized with the boric acid ester of a 1 to 6-valent alcohol which is commercially available under the trade name Glyecin CD (BASF). The fabric prepared in this manner can be heat transfer printed with conventional transfer printing dyestuffs, and after the swelling stabilizer has been removed by rinsing with water or a solvent, prints with reasonable color transfer and light fastness values are obtained. Particularly good results are achieved with dyestuffs comprising C.I. Disperse Yellow 54, C.I. Vat Red 41, C.I. Disperse Red 60, C.I. Solvent Blue 63, and C.I. Disperse Blue 332. Traditionally, however, silk prints demand bright colors and the conventional toner gives rather ineffective dull shades only. This is especialy so with black toners which yield a shade of dark brown. Toners which produce brighter colors would, of course, be highly desirable.

Objectives

It is an objective of this invention to provide a magnetic toner with sublimable dyestuffs that gives highly intense, light fast colors and deep blacks on anodized aluminum. It is a further objective of this invention to provide a magnetic toner with sublimable dyestuffs that gives bright prints and deep blacks on natural silk. It is a further objective of this invention to provide a magnetic development powder which is capable of deep penetration of pile materials and in particular carpets without dyestuff pollution problems and, in particular, without the problems associated with contamination or pollution of the magnetic brush used in the transfer operation. It is a further objective of this invention to provide a magnetic toner with sublimable dyestuffs which produces prints of exceptional intensity and pentration on polyester fabrics.

SUMMARY OF THE INVENTION

The above objectives are achieved in accordance with the present invention by providing a dry and free-flowing electro-photographic development powder in which the powder is formed of essentially spherical particles having a diameter between about 5$\mu$ (microns) and about 50$\mu$. The spherical particles comprise an organic binder in which are dispersed small particles of ferromagnetic material, highly conducting carbon particles, at least 5% by weight of a dyestuff which will evaporate from the small particles within two minutes when exposed to atmospheric pressure and a temperature of 210° C., and at least 4% of a surface active agent. The spherical particles are preferably structured to have an inside nucleus zone and an outside shell zone. The inside nucleus zone contains the dyestuff and the surfactant, and the outside shell zone contains the magnetic material and the highly conducting carbon. Highly conductive carbon powders consist typically of particles with a mean diameter of 20 to 50 millicrons which are highly graphitic.

DETAILED DESCRIPTION OF THE PREFERRED EMBODIMENTS

The fundamental differences between the toner of this invention and toners of the prior art in part comprises the use of high concentrations of surface active compounds which serve as release agents that intensify the sublimation process. The utilization of the high concentrations of surface active compounds is achieved by development of a novel structure of the toner particles which allow the use of very high concentrations of surface active compounds as well as the use of deep penetrating dyestufs. The novel structure of the toner particles in accordance with the present invention result in virtual elimination of dyestuff contamination of the magnetic brushes used in the transfer operation.

Distinguishing characteristics of the toner particles of the prior art is that dyestuff, magnetite and carbon are encapsulated or enclosed by the same polymer and have to be considered a mixture of the polymer, the magnetite, the carbon and the organic particles of sublimable dyestuff. In contrast, the toner particles of the present invention consist of an inner nuclear zone and an outer shell zone. The creation of two zones permits the separation of the magnetite from the dyestuff. This in turn permits separate optimization of the most favorable environment for these two vital ingredients, i.e., the magnetite and the dyestuff. If the magnetic particles are imbedded in the inner nuclear zone, then the dyestuff, surface active compound and carbon particles are made part of the outer shell zone and if the dyestuff and surface active compound are imbedded in the inner zone, then magnetic material and carbon are part of the outer zone.

In order to obtain transfer prints of maximum possible intensity, the amount of dyestuff in the toner should be as large as possible and the amount of the other components, in particular magnetite, carbon and organic binder as small as possible. The amount of binder necessary is largely determined by the pysico-chemical properties of the organic binder material, in particular its pigment encapsulating or enclosing potential which, because of the two zone structure of the toner particles, can be optimized separately for the sublimable dyestuff and the magnetic material.

The carbon constituent and also the magnetic material such as magnetite are preferably contained in the outside shell zone of the toner particle because the carbon in the surface shell has the largest influence on the vital surface conductivity of the toner, and if the magnetic material is placed in the outside shell only, magnetic shielding due to Coulomb's law for magnetic dipoles is reduced and the quantity of magnetic material per toner particle can be limited to the minimum amount necessary. The magnetic material can, however, be contained in the inner, nuclear zone if so desired. The carbon material, on the other hand, should always be contained in the outside shell zone. It was very surprising to find that addition of a large amount of surface active agents to the dyestuff carrying zone of the toner particles led to an increase of the intensity of the heat transfer print. For example, if toners A and B had the same particle size distribution, the same structure of particles with magnetite and carbon in the outer shell and the same chemical composition with the exception that toner A had 70% dyestuff and 30% binder in the inner nucleus and toner B 68% dyestuff, 26% binder and 6% of a surface active, long-chained aliphatic amine, then it was observed after heat transfer that depending on the dyestuff used, toner B gave images which were up to 35% more intense than those obtained with toner A.

Toner particles that contain virtually no surfactant at all can be obtained if the aqueous dispersions are prepared with dispersion agents which evaporate with the water during the drying process.

It was found that best results were obtained with surface active compounds with a hydrophilic-lyophilic balance (HLB) number between 12 and 16 (for a description of the HLB concept see e.g. W. Griffin J. Soc. Cosmetic Chemists, 5, 249 [1954]). Particularly effective were amphiphilic molecules which possessed a polar head group attached to a long aliphatic tail.

The surfactants were most effective when they were added during the dispersion or grinding operations, but the intensification phenomenon could also clearly be noticed if they were simply added to the aqueous dispersions of dyestuff particles and binder. Their effectiveness seems to indicate that in their absence, during the preparation of toner particles, agglomerates of the dyestuff particles are formed. This leads to a reduction of the effective surface from which the dyestuff molecules can evaporate and with it to a reduction of the speed of sublimation. This formation of agglomerates can obviously not be prevented by the small amount of dispersion agent which is usually applied for the stabilization of aqueous dispersions.

The polar groups of the surface active agents are probably attached, at least in the drying period, to polar groups of dyestuff molecules in the surface of the pigment crystals forcing the long aliphatic chain of the surfactant to form a protective sphere around the pigment particles and preventing the formation of agglomerates. That fairly large amounts (up to 20%) of these surfactants are necessary to bring the intensification effect to the optimum seems to indicate that strong pressures are at work to force the dyestuff particles together during the drying process.

As far as the nature of the surfactant is concerned, particularly good results have been achieved with cation active agents. The efficiency of each investigated surface active compount varied with the nature of the dyestuff. There are strong indications that not only the chemical composition of the dyestuff but also its crystal structure are important.

It was confirmed experimentally that the addition of large amounts of surface active additives will also have a limited effect in increasing the intensity of the print for conventional toners. The use of large amounts of surface active agents is less favorable when used with conventional toners because magnetite, carbon and the dyestuff are dispersed together in the conventional toners. The surface active compounds are therefore less effective because of competition between the three separate constituents of the dispersion.

The toner composition with particles having the structure demanded by this invention is preferably produced by first forming the inner nucleus sphere of each particle by any of the known processes for the production of toner particles, e.g., grinding with a ball mill (see for example French Pat. No. 7,664,819), jet milling (see for example U.S. Pat. No. 3,627,682) or spray drying (see for example U.S. Pat. No. 3,627,682). For the encapsulation process which leads to the creation of an outer shell around the inner nucleus of the particles, spray coating was found to be a suitable method (see e.g. U.K. Pat. No. 1,403,584).

For the binder material, best results were obtained with high molecular organic substances which had a softening range between 60° and 200° C. and preferably between 75° and 150° C. For both the inner nucleus and the outer shell of the toner particles, binders are selected which have the largest possible pigment encapsulating or enclosing potential. Consideration of the pigment encapsulation or enclosing potential alone is however, not sufficient as a criterion for selection of a binder because these substances are responsible, after application of pressure, for the adhesion of the toner particles to the substrate which serves as base for the transfer paper. Two factors have a major influence on the adhesion of a high molecular organic substance to the substrate:

1. The ability of the organic substance to chemically interact with the attract molecules on the substrate surface.

2. The ability of the binder to flow out and "wet" the surface.

If the base of the transfer paper consists of zinc oxide dispersed in a polymer binder, it is likely that the "wetting" effect is responsible for the adhesion of the toner to the paper after the fixing process. If the paper base is plain paper, chemical interaction through hydrogen bonding of acid groups in the binder of the toner with polar groups in the cellulose seem to be most likely to be responsible for adhesion of the toner to the paper.

Aqueous solutions or dispersions of resins which are particularly useful for the spray coating technique are well known in the art because of their use for water based printing inks. Many such compounds can, for example, be found in E. Karsten, "Lackrohstoff-Tabellen", edited by O. Luckert, published by C. R. Vincentz, Hannover 1981. Those resins which are particularly useful for pressure fixing toners are listed for example in the Japanese Patent Application Nos. 50-11 276 and 50-11 277 of Hitachi Metals Ltd. Typical examples are homopolymers like styrenes, vinyls, acrylics, polyethylene, polyvinyl chlorides, polyvinylacetate, polyoxethylene, copolymers of ethylene-acrylics, ethylene-vinyl acetate, acrylicvinyl acetate, styrene-maleic anhydride, various forms of waxes and mixtures between these compounds. Particularly good adhesion was observed when the binder of the outside shell zone of the toner particles contained at least 50% of a copolymer of styrene-maleic anhydride or of a wax with a softening point between 75° and 150° C.

It is vital for the success of the process that, on heat transfer, sticking of parts of the binder together with the black carbon and magnetite to the textile fabric surface can be avoided. Otherwise the process would be commercially unacceptable.

In accordance with the present invention the two layer structure of the toner particles permits the optimization of the quantity of dyestuff in the toner particles and their release properties, both factors leading to an increase of the density of the printed image.

Following is a list of the dyestuffs which showed increased intensity on heat transfer when surfactants were added to the part of the toner particles which contained the dyestuffs. Also listed is the observed intensity increase which was obtained. As surfactant a mixture of high molecular aliphatic primary, binary and tertiary amines of natural fats was applied using 16 parts of it with 10 parts of dyestuff.

| | Observed Intensity Increase |
|---|---|
| C.I. Disperse Yellow 54 | 35% |
| C.I. Disperse Orange 1 | 30% |
| C.I. Disperse Red 11 | 30% |
| C.I. Vat Red 41 | 40% |
| C.I. Disperse Red 60 | 35% |
| C.I. Disperse Violet 23 | 25% |
| C.I. Disperse Blue 19 | 20% |
| C.I. Disperse Blue 72 | 25% |
| C.I. Disperse Blue 293 | 20% |
| C.I. Disperse Blue 331 | 15% |
| C.I. Disperse Blue 332 | 20% |

This list is naturally not meant to be complete. The two toner systems which served for comparison contained the same total amount of dyestuff. The reproducibility was ±5%.

Essentially the same observed intensity increase was obtained for toners which had the dyestuff in the outer shell as for toners which had the dyestuff in the inner nucleus, although the optimum print density was observed with toners which had the dyestuff in the inner nucleus. For toners in which magnetite and dyestuff components are mixed with each other and are not physically separated in separate zones within the individual particles of the toner, the increase in intensity is not as pronounced unless the concentration of the surface active agent is used in much greater concentrations.

For prior art toners in which magnetite and dyestuff components are mixed with each other, as well as for toners of the present invention in which the dyestuff is contained in the outside shell zone, excessive concentrations of surface active agents (larger than about 5% by weight) have to be avoided. If excessive concentrations of surface active agents are used, the rheological properties of the toner are disturbed by the surface active agents located in or at the surface of the toner particles. This results in lumps of toner adversely forming on the magnetic brush, which inhibits or prevents correct development of the image. This lumping phenomena is not observed when using toners of the present invention in which the dyestuff and surface active agent are contained in the inner nucleus zone of the toner particle, even when concentrations of surface active agents in excess of 5% have been employed in the toner. Because of the lumping phenomena, the concentration of surfactants in the dispersions of toners prepared in accordance with the prior art has been kept very small, preferably less than 3%. See for instance, example 2 of U.S. Pat. No. 4,145,300 and example 1 of Patent Cooperation Treaty Application No. W083/00235 of Jan. 20, 1983.

If the toner particles contain more than one dyestuff, or if toner particles containing different dyestuffs are mixed together, then it is important that the dyestuffs involved have similar rates of evaporation within the specified temperature ranges used in the transfer process. The specific temperature ranges depend largely on the nature of the support. When transfer printing on silk, for example, the specified temperature range is from about 160° C. to about 205° C. For transfer printing on anodized aluminum, the temperature range is from about 160° C. to about 210° C. If the toner system being utilized contains dyestuffs which evaporate at different rates at any temperature within the specified temperature ranges, poor reproducibility of colors are achieved due to unavoidable fluctuations in temperature which occurs during a typical transfer printing operation.

When toners in accordance with the present invention are used to print on polyester materials, brighter prints are achieved than those obtained with conventional toners. In addition the transfer time can be prolonged to achieve increased penetration of the dyestuffs into the polyester material with no decrease or other adverse effect on the brightners of the print. When toners in accordance with this invention are used to print on natural silk materials, the brightness of the prints characteristic for such materials can now be obtained together with deep blacks.

The encapsulation process of the present invention also allows electro-photographic toners to be made in accordance with the invention which utilize highly volatile deep penetrating dyestuffs. Heretofore, such dyestuffs could not be utilized in conventional toners. As a result of the present invention, printing of carpets using transfer papers prepared by the electro-photographic technique has been made possible. In addition the toners of the present invention which are made with the penetrating dyestuffs also produce good results on natural silk materials and, in particular, result in good blacks.

The improvement in the quality of the prints made on anodized aluminum when using the toners of the present invention was particularly impressive. The most important shade in this field, namely black, can now be produced without problems on anodized aluminum when using the toners of this invention. Good prints are made with oxide film thicknesses on the anodized aluminum plates of up to 10μ or greater. If the thickness of this film is increased, the intensity of the colors after transfer is improved, but during the transfer process cracks are easily generated in the oxide film which are not only aesthetically inacceptable but which expose the aluminum to attacks by corrosion.

Representative examples which illustrate the invention and demonstrate its superiority over prior art processes are given below:

EXAMPLE 1

An aqueous suspension was prepared by mixing together 80 parts of an aqueous dispersion containing 15% polyoxyethylene and 12.5% of an ethylene-vinyl acetate copolymer, 60 parts of an aqueous dispersion containing 45% of the dyestuff C.I. Disperse Red 60, and 10 parts of a long chained aliphatic amine type surfactant. The resulting liquid dispersion was pumped through a turbine type spray dryer S-12.5-R of A/S Niro Atomizer, Denmark. The entrance temperature was 250° C. A free-flowing red powder was obtained from which particles larger than 20μ were separated.

A dispersion was then made in a ball mill by dispersing 1 part dispersion agent and 100 parts magnetic iron oxide with a mean particle size of 0.2μ in 50 parts water together with 40 parts of an aqueous dispersion containing 35% polyethylene wax having a softening point of 125° C. together with 40 parts of an aqueous dispersion containing 25% highly conductive carbon and 5 parts of an aqueous dispersion containing 42% $SiO_2$ sold commercially under the trade name "Aerosil" by Degussa.

Into the latter dispersion were stirred 50 parts of the red powder produced in the previous step together with 50 parts water. The resulting mixture was spray dried with the turbine type spray dryer and under the same conditions as were used before in the previous step of making the red powder. A free flowing red toner powder was obtained of which 80% had a particle size of between 10 and 30μ.

A similar toner powder was prepared using the same conditions and equipment as above except that the 10 parts surface active agent of the inner nucleus of the toner particles was replaced with one part surface active agent and 9 parts polyethylene wax.

Both toner powders as produced above were used in the same commercial copier to make copies on zinc oxide coated paper, and both copies from the coated paper were transferred simultaneously to a polyester fabric with the copies lying next to each other. The copies were transferred in a transfer press operating at a temperature of 210° C. The residence time in the press during the transfer operation was 40 seconds.

With a type RFC 3 spectrophotometer of Carl Zeiss, Oberkochen, the intensity of each of the prints from the respective copies on the polyester fabric was measured, and it was found that the intensity of the print produced by the copy paper made from the toner having the greater amount of surface active agent in the inner nucleus was 1.35 times larger than the intensity of the print produced by the copy paper make from the toner having the lesser amount of surface active agent in the inner nucleus.

EXAMPLE 2

100 parts of an aqueous dispersion containing 47% acrylic polymer were mixed together with 30 parts of the dyestuff C.I. Solvent Blue 36, 1 part of a dispersion agent, 0.3 parts of a defoaming agent and 20 parts of an aqueous dispersion containing 42% $SiO_2$ (Aerosil). The resulting liquid dispersion was passed through a ball mill grinder until 90% of the dyestuff particles are reduced to a diameter smaller than 1.5μ and no dyestuff particle being larger than 3μ.

The liquid was then passed through the same spray dryer and under the same conditions as in example 1. A free flowing blue powder was obtained which comprised 80% of spherical particles with a diameter between 5 and 25μ.

With a Cowles type high speed mixer, 50 parts of the blue powder are stirred with 100 parts of an aqueous dispersion containing 17.5% polyethylene wax having a softening point of 125° C. and 12.5% styrene-sodium maleate copolymer. To this dispersion were added under high intensity stirring 100 parts water, 15 parts of a dispersion containing 42% highly conducting carbon, 0.5 parts dispersion agent and 0.3 parts defoamer. The liquid is spray dried using the equipment mentioned above with an entrance temperature of 250° C. The result is a black, freely flowing toner powder consisting of spherical particles 80% of which have a diameter between 10 and 40μ.

The toner powder was used in a commercial photocopy machine employing zinc oxide coated paper and cold pressure fusing of the toner image. The transfer paper obtained in this manner was placed on top of a carpet constructed from Nylon 66 fibers with a pile height of 2 mm. The carpet backing was made from polyester. After a transfer time of 60 seconds at 200° C., the image had penetrated to the bottom of the pile. The developer station containing the toner powder of this example was placed in a laboratory oven at 40° C. for seven days without deterioration of the quality of the image which could be made by the developer station.

The same test was repeated with a toner containing the same quantity of a dyestuff which was prepared according to example 2 of U.S. Pat. No. 4,145,300. At the end of the test the aluminum roll of the developer station was covered with blue dyestuff and the transfer paper prepared with this toner produced images having an intense blue background which was unsuitable for commercial application.

EXAMPLE 3

In the first phase of this example, 100 parts of the violet dyestuff C.I. Disperse Violet 23 was dispersed together with 50 parts of an aqueous dispersion of 42% $SiO_2$ (Aerosil) in 200 parts of an aqueous dispersion of a styrene-butadiene copolymer and 10 parts of the surfactant of example 1. The styrene-butadiene copolymer had an average particle size of 0.1–0.2μ, and the dispersing thereof contained 25% polymer.

The resulting liquid dispersion was passed through a ball mill grinder until 90% of the dyestuff particles had a diameter of less than 1.5μ and the rest of the dyestuff particles were smaller than 3μ. This liquid dispersion was then passed through a spray dryer similar to that used in Example 1, with an entrance temperature of 250° C. and and exit temperature of 80° C. A blue-violet powder was formed with the powder consisting of essentially spherical particles of which 80% had a diameter between 5 and 25μ.

In the second phase of this example, 100 parts of an aqueous solution containing 35% low molecular weight copolymers of styrene and maleic anhydride with a pH of about 9 were mixed together with 400 parts of water, 50 parts of an aqueous dispersion containing 35% polyethylene with a softening point of 125° C., 60 parts of magnetic iron oxide with an average particle size of about 0.2μ, 20 parts of a dispersion containing 25% graphite in water, 0.5 parts of a dispersion agent and 0.2 parts of an antifoam agent. The mixture was passed through a ball mill and a dispersion of excellent stability was obtained.

To 100 parts of the dispersion made in the second phase of this example, there was added 30 parts of the blue-violet powder prepared in the first phase of this example and the mixture was formed into a dispersion in a high speed Cowles type mixer. The liquid dispersion was then passed through the spray dryer similar to that used in Example 1, with an entrance temperature of 250° C. and an exit temperature of 80° C. A free flowing black toner powder was formed, with the powder consisting of essentially spherical particles of which 80% had a diameter between 10 and 50μ.

The toner powder was used in a commercial photocopier machine using magnetic brush development and zinc oxide coated paper. The transfer paper obtained in this manner was placed below a plate of highly pure aluminum which had been anodized in sulfuric acid to form an oxide film of about 10μ thickness. The metal-paper sandwich was heated in a conventional heat transfer press for one minute at 200° C. A very intense reddish blue image was obtained which was sealed in boiling water for one hour. The sealed image was exposed for 500 hours in the Xenon-test combined with water spray. The image had a light-fastness of 4 (on the 1–5 gray scale). No damage to the oxide film was observed, provided the anodization had been performed no more than six months before the transfer.

EXAMPLE 4

The operations of example 3 were repeated except that the dyestuff consists of a mixture of 50 parts C.I. Disperse Blue 331, 36 parts C.I. Disperse Red 60 and 14 parts C.I. Disperse Yellow 54.

A free flowing black powder was obtained which was used as toner development powder in a commercial photocopier utilizing zinc oxide coated paper and magnetic brush development. A copy of a single color design was obtained.

A fabric of natural silk with a weight of 10 grams per square meter was padded with a solution of 20% Glyecin CD(R) (BASF) in water so that the slik material doubled its weight. The silk material was then dried 2 minutes at 120° C. The pretreated fabric was heat transfer printed in a conventional transfer press for 40 seconds at a temperature of 205° C. After transfer the fabric was rinsed in water and dried. A deep black copy of the original design was obtained with good light and crocking fastness.

EXAMPLE 5

In the first part of this example an aqueous dispersion was prepared in a ball mill. The dispersion contained 80 parts of magnetite, 4 parts of the dyestuff C.I. Disperse Red 60, 1 part $SiO_2$ (Aerosil), 4 parts highly conducting carbon, 1 part surfactant and 40 parts of polyethylene (in form of a 35% aqueous dispersion).

In a second part of this example the same dispersion as in the first part was prepared with the exception that the one part surfactant was replaced with B 20 parts of the surfactant of example 1.

Both dispersions were passed through the spray dryer similar to that used in example 1, with the same operating conditions. The two black powders obtained were used as toner developers in a commercial copier utilizing zinc oxide coated paper.

The dyestuff present in the images of the two transfer papers was transferred for 30 seconds at a temperature of 210° C. to a polyester fabric. The prints obtained when using the toner development powder of part 2 of this example were consistently 15 to 20% higher in intensity than the prints with the prints obtained when using the toner development powder of part 1 of this example.

Although preferred embodiments of the invention has been disclosed and described herein, it is to be understood that the present disclosure is by way of example and that variations are possible without departing from the subject matter coming within the scope of the following claims, which subject matter is regarded as the invention.

I claim:

1. Dry and free flowing electro-photographic development or toner powder of essentially spherical particles which have a diameter between about 5μ and about 50μ, said particles comprising an organic binder, ferromagnetic material, highly conducting carbon particles, a surface active compound, and a dyestuff which is adapted to evaporate from said particles in one minute at atmospheric pressure and a temperature between about 140 degrees C. and about 220 degrees C., wherein said dyestuff is present in an amount of at least 5% by weight of said powder and said surfactant is present in an amount of at least 4% by weight of said powder, and further wherein substantially each of said particles of said powder consists of two different solid phases in which the inner nucleus phase is surrounded by an outside shell phase, said inner nucleus phase comprising a first organic binder which is essentially void of ferromagnetic material, with 10% to 75% by weight of said inner nucleus phase consisting of said dyestuff and 4% to 20% by weight of said inner nucleus phase consisting of said surfactant, said outer shell phase, which is essentially void of dyestuff, comprising a second organic binder, with 30% to 80% by weight of said outer shell phase consisting of small particles of said ferromagnetic material and 2% to 20% by weight of said outer shell phase consisting of small particles of said highly conducting carbon.

2. Development or toner powder according to claim 1 for which the surfactant is cation active.

3. Development or toner powder according to claim 1 for which the surfactant is an aliphatic amine.

4. Development or toner powder according to claim 1 for which the ferromagnetic material is magnetite.

5. Development or toner powder according to claim 1 for which the binder of the inner nucleus phase is a resin selected from the group consisting of styrene, acrylics, polyvinyl chloride, polyvinyl acetate, polyolefine, polyoxyethylene, or a copolymer of ethylene-acrylic, butadienestyrene, ethylene-vinyl acetate, acrylic-vinyl acetate with a softening point between 60° and 200° C., while the binder of the outside shell phase contains at least 50% of a low molecular weight copolymer of styrene-maleic anhydride or of a wax.

6. Development or toner powder according to claim 1 that contains a group of dyestuffs which are adapted to be transferred from a conventional heat transfer printing paper in the temperature range of 160° to 210° C. with the same rate to a sheet of anodized aluminum with an oxide film thickness of 10μ.

7. Development or toner powder according to claim 6 which contains at least one of the dyestuffs C.I. Disperse Violet 23, C.I. Disperse 27, C.I. Disperse Blue 331, C.I. Vat Red 41.

8. Development or toner powder according to claim 1 that contains a group of dyestuffs which are adapted to be transferred from a conventional heat transfer printing paper in the temperature ranges of 160° to 205° C. with the same rate to natural silk the fibers of which were swollen in water and for which the swollen state has been conserved after drying through introduction into the fibers of 20 to 30% by weight polyethylene glycol 300.

9. Development or toner powder according to claim 8 which contains at least one of the dyestuffs C.I. Disperse Blue 332, C.I. Vat Red 41, Solvent Blue 63.

10. Development or powder according to claim 1 which contains at least one of the dyestuffs selected from the group consisting of the yellow dyestuff the formula

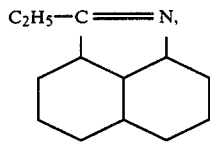

the red dyestuff 1-amino-2-chloro-hydroxyanthraquinone, 1-amino-2-brom-4-hydroxyanthraquinone, and the blue dyestuff 1,4-diisopropylanthraquinone.

* * * * *